US005820476A

United States Patent [19]

Amato

[11] Patent Number: 5,820,476

[45] Date of Patent: Oct. 13, 1998

[54] GOLF PUTTER LEVELING SYSTEM

[76] Inventor: Louis Amato, 69 Winfield Ave., Staten Island, N.Y. 10305

[21] Appl. No.: 971,515

[22] Filed: Nov. 17, 1997

[51] Int. Cl.[6] ..... A63B 69/36

[52] U.S. Cl. ..... 473/217; 473/241; 473/282; 273/DIG. 30; 36/127; 33/354; 33/379; 33/370

[58] Field of Search ..... 473/217, 241, 473/270, 282; 273/DIG. 30; 36/127; 33/354, 370, 379

[56] References Cited

U.S. PATENT DOCUMENTS 4,179,125 12/1979 Cane et al. ..... 473/241
4,991,839 2/1991 Lumbattis ..... 473/282

*Primary Examiner*—George J. Marlo

[57] ABSTRACT

A golf putter leveling system including a shoe level adapted for securement to a golf shoe. A putter level is provided that is adapted for securement to a shaft of a golf putter. The putter level includes a base portion having a lower arcuate recess and an upper arcuate recess. The lower arcuate recess has a pair of detents disposed on opposing sides thereof. The lower arcuate recess snapidly engages the shaft of the golf putter. The upper arcuate recess has a level portion disposed therein. A putter leveler is adapted for securement to the shaft of the golf putter. The putter leveler has an upper portion defined by an arcuate recess for engaging the shaft of the golf putter. The putter leveler has a lower portion defined by outwardly extending legs for supporting the golf putter at an even level so as to zero the putter level.

5 Claims, 2 Drawing Sheets

GOLF PUTTER LEVELING SYSTEM

BACKGROUND OF THE INVENTION

1. Field of the Invention

The present invention relates to a golf putter leveling system and more particularly pertains to measuring a slope of a green to enable more accurate putting with a golf putter leveling system.

2. Description of the Prior Art

The use of golf putters is known in the prior art. More specifically, golf putters heretofore devised and utilized for the purpose of putting golf balls are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,351,963 to Baek; U.S. Pat. No. 4,902,014 to Bontomase et al.; U.S. Pat. No. 4,211,415 to Lindo; U.S. Pat. No. 4,082,286 to La Breche; U.S. Pat. No. Des. 306,335 to Franey; and U.S. Pat. No. 4,824,114 to Catalano.

While these devices fulfill their respective, particular objective and requirements, the aforementioned patents do not describe a golf putter leveling system for measuring a slope of a green to enable more accurate putting.

In this respect, the golf putter leveling system according to the present invention substantially departs from the conventional concepts and designs of the prior art, and in doing so provides an apparatus primarily developed for the purpose of measuring a slope of a green to enable more accurate putting.

Therefore, it can be appreciated that there exists a continuing need for new and improved golf putter leveling system which can be used for measuring a slope of a green to enable more accurate putting. In this regard, the present invention substantially fulfills this need.

SUMMARY OF THE INVENTION

In the view of the foregoing disadvantages inherent in the known types of golf putters now present in the prior art, the present invention provides an improved golf putter leveling system. As such, the general purpose of the present invention, which will be described subsequently in greater detail, is to provide a new and improved golf putter leveling system and method which has all the advantages of the prior art and none of the disadvantages.

To attain this, the present invention essentially comprises a shoe level adapted for securement to a golf shoe. The shoe level includes a central level portion. The central level portion has adjustment knobs for leveling fluid disposed therein. The central level portion has a pair of generally L-shaped arms extending outwardly from opposed ends thereof. The L-shaped arms each have short segments extending outwardly of the central level portion and long segments extending rearwardly with respect to the central level portion. Free ends of the long segments each have circular plates disposed thereon. The plates have hook and loop patches disposed thereon for mating with corresponding hook and loop patches secured on opposing sides of the golf shoe whereby the central level portion will be positioned adjacent to a toe portion of the golf shoe. A putter level is adapted for securement to a shaft of a golf putter. The putter level includes a base portion having a lower arcuate recess and an upper arcuate recess. The lower arcuate recess has a pair of detents disposed on opposing sides thereof. The lower arcuate recess snapidly engages the shaft of the golf putter. The upper arcuate recess has a level portion disposed therein. A putter leveler is adapted for securement to the shaft of the golf putter. The putter leveler has an upper portion defined by an arcuate recess for engaging the shaft of the golf putter. The putter leveler has a lower portion defined by outwardly extending legs for supporting the golf putter at an even level so as to zero the putter level.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf putter leveling system which has all the advantages of the prior art golf putters and none of the disadvantages.

It is another object of the present invention to provide a new and improved golf putter leveling system which may be easily and efficiently manufactured and marketed.

It is a further object of the present invention to provide a new and improved golf putter leveling system which is of durable and reliable construction.

An even further object of the present invention is to provide a new and improved golf putter leveling system which is susceptible of a low cost of manufacture with regard to both materials and labor, and which accordingly is then susceptible of low prices of sale to the consuming public, thereby making such a golf putter leveling system economically available to the buying public.

Even still another object of the present invention is to provide a new and improved golf putter leveling system for measuring a slope of a green to enable more accurate putting.

Lastly, it is an object of the present invention to provide a new and improved golf putter leveling system including a shoe level adapted for securement to a golf shoe. A putter level is provided that is adapted for securement to a shaft of a golf putter. The putter level includes a base portion having a lower arcuate recess and an upper arcuate recess. The lower arcuate recess has a pair of detents disposed on opposing sides thereof. The lower arcuate recess snapidly engages the shaft of the golf putter. The upper arcuate recess has a level portion disposed therein. A putter leveler is adapted for securement to the shaft of the golf putter. The putter leveler has an upper portion defined by an arcuate recess for engaging the shaft of the golf putter. The putter leveler has a lower portion defined by outwardly extending legs for supporting the golf putter at an even level so as to zero the putter level.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
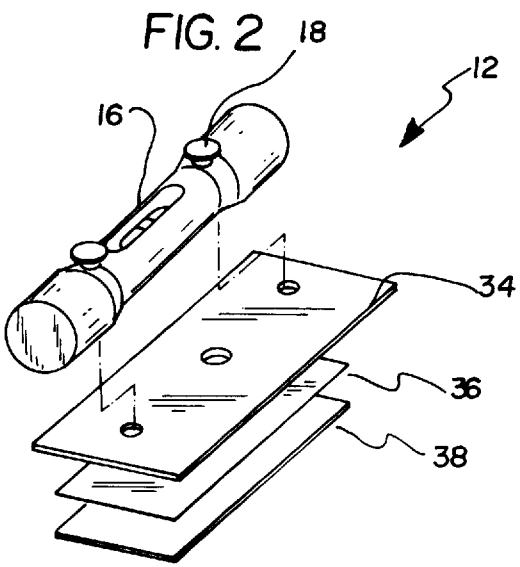
FIG. 2 is a perspective view of an alternate embodiment of the present invention.
Figure 1:
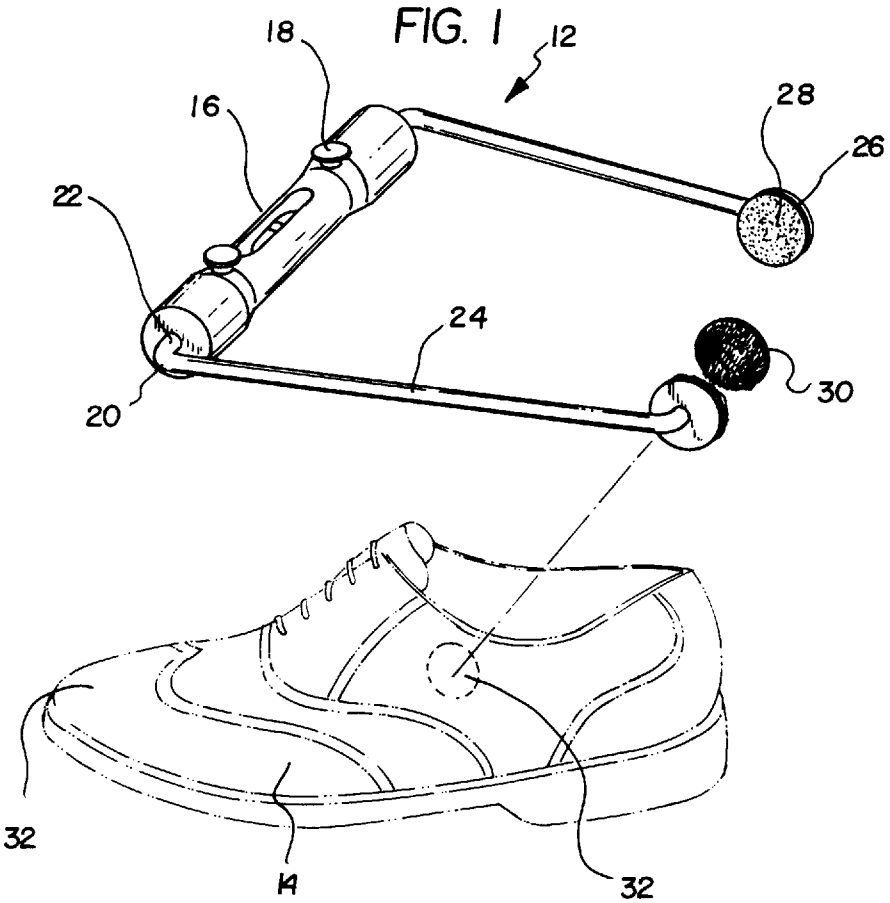
FIG. 1 is a perspective view of the preferred embodiment of the golf putter leveling system constructed in accordance with the principles of the present invention.
Figure 3:
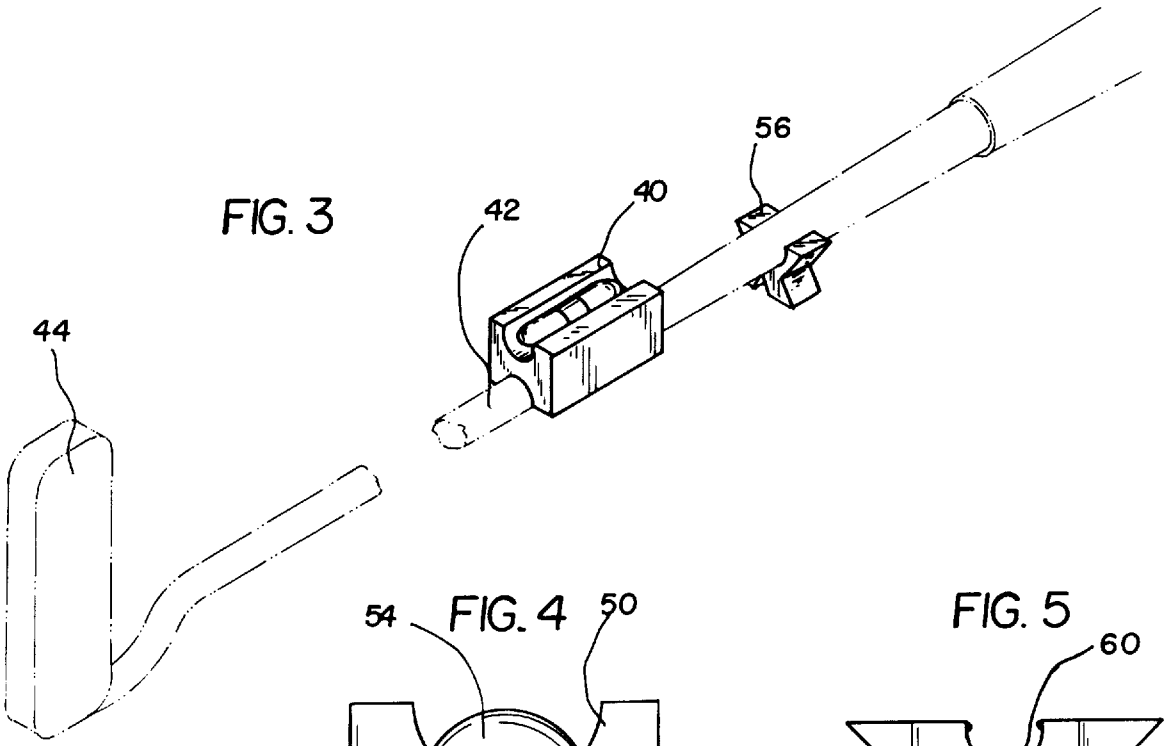
FIG. 3 is perspective view of the putter leveler and the putter level of the present invention.
Figure 4:
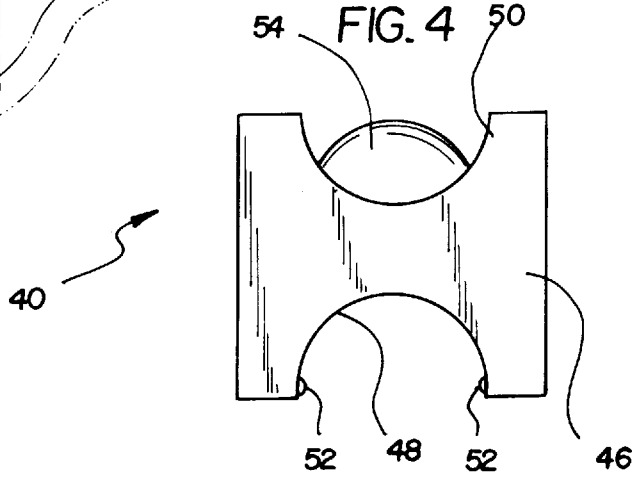
FIG. 4 is front view of the putter level as seen in FIG. 3.
Figure 5:
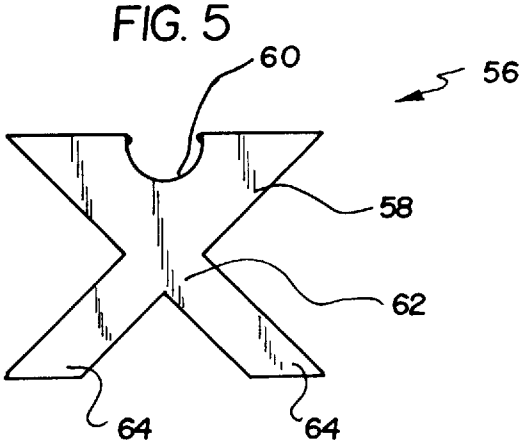
FIG. 5 is a front view of the putter leveler as seen in FIG. 3.

With reference now to the drawings, and in particular, to FIGS. 1 through 5 thereof, the preferred embodiment of the new and improved golf putter leveling system embodying the principles and concepts of the present invention and generally designated by the reference number 10 will be described.

Specifically, it will be noted in the various Figures that the device relates to a golf putter leveling system for measuring a slope of a green to enable more accurate putting. In its broadest context, the device consists of a shoe level, a putter level and a putter leveler. Such components are individually configured and correlated with respect to each other so as to attain the desired objective.

The shoe level 12 is adapted for securement to a golf shoe 14. The shoe level 12 includes a central level portion 16. The central level portion 16 has adjustment knobs 18 for leveling fluid disposed therein. The central level portion 16 has a pair of generally L-shaped arms 20 extending outwardly from opposed ends thereof. The L-shaped arms 20 each have short segments 22 extending outwardly of the central level portion 16 and long segments 24 extending rearwardly with respect to the central level portion 16. Free ends of the long segments 24 each have circular plates 26 disposed thereon. The plates 26 have hook and loop patches 28 disposed thereon for mating with corresponding hook and loop patches 30 secured on opposing sides of the golf shoe 14 whereby the central level portion 16 will be positioned adjacent to a toe portion 32 of the golf shoe 16. Note FIG. 1.

In an alternate embodiment, as illustrated in FIG. 2, the shoe level 12 is shown as to be secured to the toe portion 32 of the golf shoe 14. The central level portion 16 has a rectangular metal plate 34 secured to a lower surface thereof. The rectangular metal plate 34 has a hook and loop patch 36 disposed on a lower surface thereof for mating with a hook and loop patch 38 securable on a toe portion 32 of the golf shoe 14.

The putter level 40 is adapted for securement to a shaft 42 of a golf putter 44. The putter level 40 includes a base portion 46 having a lower arcuate recess 48 and an upper arcuate recess 50. The lower arcuate recess 48 has a pair of detents 52 disposed on opposing sides thereof. The lower arcuate recess 48 snapidly engages the shaft 42 of the golf putter 44. The upper arcuate recess 50 has a level portion 54 disposed therein. Note FIGS. 3 and 4.

The putter leveler 56 is adapted for securement to the shaft 42 of the golf putter 44. The putter leveler 56 has an upper portion 58 defined by an arcuate recess 60 for engaging the shaft 42 of the golf putter 44. The putter leveler 56 has a lower portion 62 defined by outwardly extending legs 64 for supporting the golf putter 44 at an even level so as to zero the putter level 40. Note FIGS. 3 and 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A golf putter leveling system for measuring a slope of a green to enable more accurate putting comprising, in combination:

a shoe level adapted for securement to a golf shoe, the shoe level including a central level portion, the central level portion having adjustment knobs for leveling fluid disposed therein, the central level portion having a pair of generally L-shaped arms extending outwardly from opposed ends thereof, the L-shaped arms each having short segments extending outwardly of the central level portion and long segments extending rearwardly with respect to the central level portion, free ends of the long segments each having circular plates disposed thereon, the plates having hook and loop patches disposed thereon for mating with corresponding hook and loop patches secured on opposing sides of the golf shoe whereby the central level portion is positioned adjacent to a toe portion of the golf shoe;

a putter level adapted for securement to a shaft of a golf putter, the putter level including a base portion having a lower arcuate recess and an upper arcuate recess, the lower arcuate recess having a pair of detents disposed on opposing sides thereof, the lower arcuate recess snapidly engaging the shaft of the golf putter, the upper arcuate recess having a level portion disposed therein; and a putter leveler adapted for securement to the shaft of the golf putter, the putter leveler having an upper portion defined by an arcuate recess for engaging the shaft of the golf putter, the putter leveler having a lower portion defined by outwardly extending legs for supporting the golf putter at an even level so as to zero the putter level.

2. A golf putter leveling system for measuring a slope of a green to enable more accurate putting comprising, in combination:

a shoe level adapted for securement to a golf shoe;

a putter level adapted for securement to a shaft of a golf putter, the putter level including a base portion having a lower arcuate recess and an upper arcuate recess, the lower arcuate recess having a pair of detents disposed on opposing sides thereof, the lower arcuate recess snapidly engaging the shaft of the golf putter, the upper arcuate recess having a level portion disposed therein; and a putter leveler adapted for securement to the shaft of the golf putter, the putter leveler having an upper portion defined by an arcuate recess for engaging the shaft of the golf putter, the putter leveler having a lower portion defined by outwardly extending legs for supporting the golf putter at an even level so as to zero the putter level.

3. The golf putter leveling system as set forth in claim 2 wherein the shoe level includes a central level portion, the central level portion has adjustment knobs for leveling fluid disposed therein.

4. The golf putter leveling system as set forth in claim 3 wherein the central level portion has a pair of generally L-shaped arms extending outwardly from opposed ends thereof, the L-shaped arms each having short segments extending outwardly of the central level portion and long segments extending rearwardly with respect to the central level portion, free ends of the long segments each having circular plates disposed thereon, the plates having hook and loop patches disposed thereon for mating with corresponding hook and loop patches secured on opposing sides of the golf shoe whereby the central level portion is positioned adjacent to a toe portion of the golf shoe.

5. The golf putter leveling system as set forth in claim 3 wherein the central level portion has a rectangular metal plate secured to a lower surface thereof, the rectangular metal plate having a hook and loop patch disposed on a lower surface thereof for mating with a hook and loop patch secured on a toe portion of the golf shoe.

* * * * *